US012146664B2

(12) United States Patent
Brunner et al.

(10) Patent No.: US 12,146,664 B2
(45) Date of Patent: Nov. 19, 2024

(54) COOKING APPLIANCE HAVING A SPECIFIC DAMPING UNIT BETWEEN GUIDE TRACKS OF A GUIDE DEVICE FOR A LOWERABLE DOOR

(71) Applicant: BSH Hausgeräte GmbH, Munich (DE)

(72) Inventors: Martin Brunner, Pforzheim (DE); Andrea Lenz, Bretten (DE); Kerstin Sickert, Bretten (DE)

(73) Assignee: BSH Hausgeräte GmbH, Munich (DE)

( * ) Notice: Subject to any disclaimer, the term of this patent is extended or adjusted under 35 U.S.C. 154(b) by 519 days.

(21) Appl. No.: 17/432,127

(22) PCT Filed: Feb. 19, 2020

(86) PCT No.: PCT/EP2020/054292
§ 371 (c)(1),
(2) Date: Aug. 19, 2021

(87) PCT Pub. No.: WO2020/169639
PCT Pub. Date: Aug. 27, 2020

(65) Prior Publication Data

US 2022/0154943 A1 May 19, 2022

(30) Foreign Application Priority Data

Feb. 22, 2019 (DE) ..... 10 2019 202 418.1

(51) Int. Cl.
*F24C 15/02* (2006.01)

(52) U.S. Cl.
CPC ..... *F24C 15/026* (2013.01)

(58) Field of Classification Search
CPC ..... F24C 15/026
See application file for complete search history.

(56) References Cited

U.S. PATENT DOCUMENTS 8,047,198 B2 11/2011 Meyer
2021/0116133 A1 4/2021 Alt

FOREIGN PATENT DOCUMENTS

DE 7042009 U 4/1971
DE 102011086970 A1 * 5/2013 ..... F24C 15/026
(Continued)

OTHER PUBLICATIONS

International Search Report PCT/EP2020/054292 dated May 5, 2020.

*Primary Examiner* — Jason Lau
(74) *Attorney, Agent, or Firm* — Michael E. Tschupp; Andre Pallapies; Brandon G. Braun

(57) ABSTRACT

A cooking appliance includes a door for closing a cooking chamber and a guide device to guide a movement of the door into or out of a separate stowing space. The guide device includes a guide unit connected to the door and guided in a slotted guide. The guide unit, when viewed in a height direction, includes a lower guide element and a higher guide element, with the lower guide element moving on a lower guide track without contact with a separate upper guide track, and with the higher guide element moving on the upper guide track without contact with the lower guide track. A damping unit is coupled to the guide unit such that at least a partial closing path is damped as the door is closed between an intermediate position thereof on a closing path of the door and a completely closed end position of the door.

15 Claims, 9 Drawing Sheets

(56) References Cited

FOREIGN PATENT DOCUMENTS

| | | | | | |
|---|---|---|---|---|---|
| DE | 102015222796 | A1 | | 5/2017 | |
| EP | 1764558 | A2 | * | 3/2007 | ..... E05F 5/027 |
| EP | 2597378 | B1 | | 1/2020 | |

* cited by examiner

COOKING APPLIANCE HAVING A SPECIFIC DAMPING UNIT BETWEEN GUIDE TRACKS OF A GUIDE DEVICE FOR A LOWERABLE DOOR

CROSS-REFERENCES TO RELATED APPLICATIONS

This application is the U.S. National Stage of International Application No. PCT/EP2020/054292, filed Feb. 19, 2020, which designated the United States and has been published as International Publication No. WO 2020/169639 A1 and which claims the priority of German Patent Application, Serial No. 10 2019 202 418.1, filed Feb. 22, 2019, pursuant to 35 U.S.C. 119 (a)-(d).

BACKGROUND OF THE INVENTION

One aspect of the invention relates to a cooking appliance comprising a cooking chamber. The cooking appliance also comprises a door which is designed to close the cooking chamber. The cooking appliance also comprises a stowing space which is separate from the cooking chamber and into which the door can be lowered in the open state. The door is guided by a guide device of the cooking appliance as the door is moved into the stowing space and/or out of the stowing space. The guide device has at least one slotted guide in which a guide unit of the guide device is guided.

Such an embodiment of a cooking appliance is disclosed, for example, in DE 7042009 U. A guide device is provided therein. Guide rollers are guided on lateral guide rails. These rollers are fixedly connected to a hinge plate and this hinge plate is connected to the door. In the inserted state of the door the guide rail, in which the rollers are guided, is arranged below the door. When viewed in the width direction, the door overlaps this guide rail.

A device comprising a door is also disclosed in DE 10 2006 002 409 A1. The cooking appliance therein has a door which is lowerable into a stowing space. In this case a guide track is also provided, a guide carriage being moved along said guide track. The guide track is configured on a side wall which defines the stowing space. The guide track is arranged offset upwardly and at a distance from a bottom which downwardly defines the stowing space. As a result, the guide track is displaced relatively far upwardly. In the retracted state of the door into the stowing space, this guide track and the guide in which the guide carriage moves are arranged adjacent to one another and thus at the same height position, when viewed in the width direction. As a result, only doors having a limited width may be used.

A household appliance with a lowerable appliance door is disclosed in DE 10 2011 086 970 A1. In this case, the door is able to be damped by a damping member only during an opening movement. In this case, the structural design provides that only one guide groove is configured, a guide element which is configured as a carriage being guided therein. The guide element is coupled to the damping member in order to damp the opening movement. The damping member is of complex construction and has a plurality of elements interacting with one another and meshing together. As a result, the damping member takes up a large amount of constructional space.

BRIEF SUMMARY OF THE INVENTION

It is an object of the present invention to provide a cooking appliance in which the guidance of a door out of a stowing space into the closed end position is improved.

This object is achieved by a cooking appliance which has the features as claimed in claim 1.

One aspect of the invention relates to a cooking appliance comprising a cooking chamber. The cooking appliance also comprises a door which is designed and arranged to close the cooking chamber. Moreover, the cooking appliance comprises a stowing space which is separate from the cooking chamber. The door can be lowered into this stowing space in the open state. The door is guided by a guide device of the cooking appliance as the door is moved into the stowing space and/or out of the stowing space. The guide device preferably has at least one slotted guide in which a guide unit of the guide device is guided. The guide unit is thus movable within the slotted guide, relative to the slotted guide. The relevant guide unit is connected and thus mechanically coupled to the door. The guide unit has a guide bracket, at least two separate guide elements being arranged thereon. These guide elements are arranged at different height positions, when viewed in the height direction of the cooking appliance. It is preferably provided that the guide element which is lower in the height position moves on a guide track and is arranged without contact with a further guide track of the guide device which is separate therefrom. The guide element which is higher in the height position preferably moves on the further guide track and is arranged without contact with the other guide track. The cooking appliance has at least one damping unit which, starting from an intermediate position of the door on the closing path of the door, is coupled to the guide unit such that at least a partial closing path is damped as the door is closed between the intermediate position and the completely closed end position of the door.

A guidance of the door as it moves out of the stowing space is improved by means of such an embodiment. Moreover, the damping unit can be replaced rapidly for maintenance purposes or in the case of full replacement.

In this context, preferably wider doors may also be used since the slotted guide is preferably located physically below the door. Thus it is also possible to use doors which at least overlap the guide track, when viewed in the width direction of the cooking appliance.

Advantageously, it is provided that the at least one damping unit, when viewed in the height direction of the cooking appliance, is arranged between the upper guide track and the lower guide track which is arranged therebelow in the height direction. By such an arrangement of the damping unit located between said guide tracks, the constructional space between the guide tracks may be used in order to be able to attach an additional separate unit therein. On the one hand, as a result the entire arrangement is in contact and, on the other hand, by means of this embodiment the damping unit is locally arranged immediately adjacent to these guide tracks, in particular the upper guide track. A corresponding coupling of the damping unit to the moving guide unit is thus possible in a very simple and reliable manner. By the possibility already provided in principle by the embodiment with the two guide tracks arranged offset to one another in the height direction, this is advantageously complemented in this regard by the advantageous installation of the damping unit. As a result, the damping unit itself may also be of very small and compact construction whilst the reliable coupling to the guide unit is still permitted. In particular, this allows in turn the damping on this defined partial closing path in a very precise and highly functional manner.

It is preferably provided that the stowing space is defined by a vertical side wall, wherein the upper guide track is configured in the side wall and the damping unit is arranged in this side wall. By means of such an embodiment, the damping unit may be installed in a very stable and robust component, namely the side wall. A high degree of positional stability is also achieved thereby. Moreover, due to this position of the damping unit, effectively a lateral installation is also possible relative to the stowing space. The stowing space itself, in particular relative to the movement of the door into the stowing space or out of the stowing space, is not impaired thereby and does not have to be reduced.

Preferably, the stowing space is defined by a further vertical side wall which is opposite in the width direction. In an advantageous embodiment, a further separate damping unit may also be arranged thereon. In particular, it is provided that the stowing space is defined to the rear by an additional rear wall. Moreover, the stowing space may be defined by a bottom wall and by a ceiling wall.

Advantageously it is provided that the upper guide track, when viewed in the depth direction of the cooking appliance, has a front longitudinal third. The damping unit is arranged below the upper guide track and, when viewed in the depth direction, is arranged in this front longitudinal third. In particular, in terms of its length the damping unit is completely arranged in this longitudinal third, when viewed in the depth direction. By such a specific positioning of the damping unit relative to the upper guide track, when viewed in the depth direction, it is additionally possible to construct the damping unit to be particularly compact whilst it is still possible to generate the damping action only over this above-mentioned partial closing path as the door is closed. In this context, additional extensive and complex coupling devices do not have to be provided between the damping unit and the guide unit. As a result, a direct coupling is also possible and the coupling paths and/or the coupling chain between the damping unit and the guide unit are minimized.

Advantageously, it is provided that the damping unit is configured as a pneumatic or hydraulic damper. Such embodiments are able to be of compact construction and are mechanically robust and highly functional. In particular, relative to other types of damping units, such as for example electrical or magnetic damping units, in this regard an advantage is provided thereby. Moreover, the low maintenance requirement is a further advantage.

Additionally or alternatively, it may be provided that the damping unit is configured with a cartridge-like housing. Such a tubular and/or cylindrical embodiment of a housing permits a correspondingly compact construction but nevertheless with a highly functional damping action. The functionality which is configured, in particular, in a pneumatic or hydraulic damper may be implemented in a particularly compact manner in such a cartridge-like housing.

It is preferably provided that the damping unit is coupled directly to the guide unit on the partial closing path. The compact and space-saving construction is also promoted thereby and a very direct and low-tolerance damping action is present.

It is preferably provided that the damping unit is directly connected to a transmission element, wherein the transmission element is directly coupled to the guide unit on the partial closing path. Thus it is possible to permit in a targeted manner the direct mechanical coupling to the guide unit at specific points, in particular in the height direction in the region of the upper guide track. In this context, therefore, other components remain unaffected. In particular, it may be provided that the transmission element is configured as a bracket. For example, an L-shaped embodiment of the bracket may be provided here. By means of this embodiment, the damping unit, when viewed in the width direction of the cooking appliance, may be installed in this aforementioned vertical sidewall, in particular may be arranged embedded in this vertical side wall by at least 50 percent, in particular by at least 70 percent, in particular by at least 90 percent. As a result, when viewed in the width direction, the damping unit is arranged so as not to protrude, or only minimally, into the stowing space. With such a recessed and/or embedded arrangement of the damping unit, the possibility is nevertheless provided, in particular for this transmission element, to come into direct mechanical contact with the guide unit which is arranged at least in some regions to the side of the damping unit, in particular a guide bracket of this guide unit, when this guide unit, in particular the guide bracket, moves in the depth direction of the cooking appliance relative to the vertical side wall.

It is preferably provided that the transmission element is displaceably arranged in the depth direction such that, with the coupling of the guide unit to the transmission element and with the further movement of the guide unit guided on the partial closing path in the depth direction, the transmission element is guided forward with the guide unit and the damping unit is activated and/or actuated for the damping by this movement and with this movement. By means of a relatively small element, as is formed by the transmission element, a highly effective coupling to the guide unit and a very precise movement may be permitted thereby, whereby the damping is also initiated and brought about in a very precise manner on this defined partial closing path.

It is preferably provided that the transmission element has at least one guide web, an anti-rotation device being formed thereby for the transmission element as it moves in the depth direction. In particular, rotation is prevented about an axis which extends in the depth direction or substantially in the depth direction. Thus an undesired mechanical contact with other components of the door may be prevented, as the door moves into the stowing space. Damage or functional impairments are avoided thereby.

It is preferably provided that the coupling of the guide unit to the damping unit for damping the movement of the door on the partial closing path is configured at a distance measured in the depth direction from the front end of the upper guide track of between 20 mm and 30 mm, in particular between 20 mm and 25 mm. By such a specific positioning of the components, when viewed in the depth direction of the cooking appliance, a defined partial closing path which, on the one hand, is not too short and, on the other hand, is not too long is achieved in a particularly precise manner. In particular, with such partial closing paths which are dimensioned to be relatively short relative to the entire movement path of the door between an open position and a closed position, therefore, it is particularly important and advantageous that only minimal or even no tolerances at all are produced relative to the adjustment of the damping action. Otherwise, a closing of the door which is too extensive and slow could occur if this damping starts too early and takes place over a relatively long path and, on the other hand, if the damping action starts too late, an undesired hard impact occurs in the closed end position. By this aforementioned positioning in the depth direction, in this regard a very advantageous position of the damping unit is achieved which takes account of these aspects.

It is preferably provided that an initial portion of the partial closing path as the door is closed is configured at an angular position of the door of between 20° and 12°, in particular between 17° and 13°, relative to the vertical. The partial closing path is defined, therefore, over a relatively small angular interval. The aforementioned advantages are also achieved thereby. In particular, with such short partial closing paths it is possible to initiate the damping action in a precise and accurate manner and the precise damping action over the partial closing path is thus also advantageous.

It is preferably provided that the partial closing path does not extend as far as the completely closed end position of the door, such that an end closing path which adjoins the partial closing path as the door is closed and extends as far as the completely closed state of the door is undamped. As a result, the closing process of the door is accelerated whilst an undesired hard impact in the completely closed end position is nevertheless prevented.

In particular, with a closing process between the completely open end position and the completely closed end position, a damping of the movement of the door is configured only on the partial closing path.

Advantageously it is provided that the damping unit has a freewheel such that the damping action is deactivated on the end closing path. This non-damping on the end closing path may thus be achieved in a very simple and yet highly functional and precise manner. An additional unit which prevents the damping in this regard does not have to be installed, but the damper is designed such that it no longer damps over this end closing path.

It is preferably provided that the end closing path is dimensioned over an angular interval of between 8° and 12° relative to the vertical. It may be provided that for the damping action the damping unit is directly coupled to the door or, as has already been mentioned above, is coupled to this door and/or guide unit via a transmission element which, in particular, is configured in one piece, in particular is a bracket.

It may be provided that the damping unit itself integrates such a transmission element and thus is configured in one piece therewith. The transmission element, however, may also be a component which is separate from the damping unit and which is connected thereto. In such an embodiment, the transmission element may be connected in a non-destructive, releasable manner to the damping unit. For example, a plugging or screwing or latching or the like may be provided here.

In particular, it is provided that the damping unit has a transmission ratio such that a damping of the movement of the door takes place over the aforementioned partial closing path. In particular, in this context it may be provided that damping is carried out for a partial closing path which is dimensioned at most between 45° and 0° relative to the vertical. Due to the transmission ratio from the damping path of the damping unit and a lever arm to the pivot point of the door, a damping action of the door may be carried out over this partial closing path.

In particular, during the closing movement of the door after, for example, an opening angle of preferably 15° (start of the partial closing path) still remains and a remaining distance measurement of the coupling element of the damping unit is provided from a front end of the upper guide track of preferably 23 mm, when viewed in the depth direction, the coupling is formed between the damping unit and the guide unit, in particular a guide bracket of the guide unit. The coupling point between the damping unit and the guide unit is at this angular position and the distance measurement.

By means of this embodiment of the specific damping of the door over the partial closing path, it is also possible to achieve a noise reduction as the door moves into the closed end position. Moreover, the slow closing of the door is advantageous for sealing the door in the closed state at the interface between the door and the muffle of the cooking appliance and/or a front flange of the muffle. Moreover, by means of this slow closing of the door over this partial closing path, it is also achieved that the air is displaced more slowly between the door and the muffle and thus also the cooking chamber. This has a positive effect on preventing the door from rattling when closing, in particular on the last part of the closing movement.

In particular, it is advantageous if the cooking appliance also has a steam cooking function.

When viewed in the height direction of the cooking appliance, in particular, a guide track, in particular the slotted guide, is arranged in the stowing space below the door at least in a retracted end position of the door.

In particular, the guide track and the further guide track are arranged at different height positions and, in particular, on the same side of the cooking appliance.

The different height positions of the guide elements are configured such that, when viewed in the height direction of the cooking appliance, the guide elements are not arranged so as to overlap. This also means that the guide elements with their respective total height dimensions, when viewed in the height direction, are configured at a distance from one another. The guide elements are thus also dimensioned and arranged on the guide bracket such that they are arranged without overlap in the height direction. This applies, in particular, to the entire movement path of the guide elements in the depth direction.

In particular in the case of such doors, therefore, it may lead to a greater weight, which also has to be at least partially absorbed by the guide device during the tilting and insertion into the stowing space. The specific guide device is formed here in order to avoid undesired tilting moments. In particular to improve these technical conditions, the specific guide element is provided, namely the guide bracket and the at least two separate guide elements which are arranged thereon and which are arranged at different height positions, said guide elements being individually coupled to guide tracks arranged at different height positions. A guide bracket is understood to mean, in particular, an embodiment of a separate element of the guide device which is of rod-like design. In particular, a non-linear rod-like embodiment may be provided here. The guide elements are, in particular, separate components from the guide bracket, said guide elements being arranged on the guide bracket, in particular being arranged so as to be movable relative thereto.

Preferably the guide track is a lower guide track in the height direction. In particular, the further separate guide track is an upper guide track in the height direction. The upper guide track is thus higher than the lower guide track.

In an advantageous embodiment, the lower guide element in the height position moves on a lower guide track and is arranged without contact with an upper guide track. The upper guide element in the height position moves on the upper guide track and is arranged without contact with the lower guide track.

It may be provided that the upper guide element bears from below against an upper guide track located thereabove and is guided along said upper guide track. It may be provided that the lower guide element bears from above against a lower guide track located therebelow and is guided along said lower guide track.

It may alternatively be provided that the upper guide element bears from above against an upper guide track located therebelow and is guided along said upper guide track. It may be provided that the lower guide element bears from below against a lower guide track located thereabove and is guided along said lower guide track.

A cavity, in which the lower guide element is arranged, is preferably configured below the lower guide track and preferably as far as the bottom of the stowing space.

It may be provided that the upper guide track is an upper face of a solid web and the lower guide track is a lower face of this web. As a result, the guide tracks are configured closely adjacent to one another and on one component, the web.

In particular, in this case the guide tracks are arranged parallel to one another in some regions, but are arranged non-parallel when viewed over the entire length.

It may be provided that at least two upper guide elements and/or at least two lower guide elements are configured, said guide elements being arranged on a guide unit. The upper guide elements may be rollers. However, plain bearings, ball bearings or a rigid element such as a guide pin may also be configured. The second guide element may also be a roller or a plain bearing or a ball bearing or a guide pin.

In particular, the lower guide track, in particular the entire lower slotted guide, is arranged over its entire length in the depth direction of the appliance completely below the door (at least in the end position thereof).

It is preferably provided that the guide elements are arranged at different height positions during the entire movement between the end positions of the guide bracket along the slotted guide, when viewed in the height direction. As a result, a movement path is provided for both guide elements which is of very simple construction and thus also does not bring about any undesired jamming or blocking of this simultaneous movement of the guide elements on the individual guide tracks. In particular, therefore, there is no mutual crossover during this movement of the guide elements along the aforementioned guide tracks. The movement complexity is reduced thereby and a very simple movement sequence is possible. As a result, the aforementioned advantages may be further improved.

It is preferably provided that the guide bracket is configured to be angled. In particular, the guide bracket has a V-shape and/or is boomerang-like. A guide bracket which is mechanically very stable is possible by means of such an embodiment. In particular, a carrier unit of the guide device is also predetermined by means of this shape, which is particularly advantageous for guide elements arranged at different height positions. The different height position of the guide elements may be easily predetermined by a corresponding installed position of such a geometrically designed guide bracket, by specifically positioning the guide elements on this guide bracket. However, a different geometry of the, in particular one-piece, guide bracket may also be provided, which results in an attachment of the guide elements at different height positions.

It is preferably provided that one of the guide elements is arranged in the V-tip of the V-shape. Such an effectively central arrangement of a guide element and the coupling of the guide element to an individual guide track thus also effectively permits a corresponding tilting movement of the guide bracket about the rotational axis defined by the guide element on the V-tip. As a result, the relative movement of the guide bracket via this guide element arranged on the V-tip is also improved relative to other components of the cooking appliance.

In particular, it is provided that the lower guide element is arranged in the V-tip. This is a particularly suitable embodiment relative to the aforementioned advantages.

It is preferably provided that a guide element is arranged at a first end of the guide bracket and the other guide element is arranged on the guide bracket, at a distance from the two ends of the guide bracket. By means of such an exposed arrangement of a guide element on the end side, the arrangement may be advantageously achieved at different height positions and the individual movement guidance of the guide elements improved on the guide tracks. In particular, an undesired tilting moment of the door when inserted into the stowing space may also be avoided thereby in an improved manner. By means of this exposed position of the guide element on the end side on the guide bracket, therefore, effectively a certain support may also be implemented via this guide element on the end side, such that the guide bracket does not start to rotate by the weight force of the door but in this regard a defined tilting restriction for the guide bracket is effectively formed thereby.

It is preferably provided that the guide element at the first end of the guide bracket is the upper guide element, when viewed in the height direction. As a result, the aforementioned advantages are also further improved.

In particular, it is provided that the guide elements have different sizes. As a result, the aforementioned advantages may also be taken into account in a further advantageous embodiment.

Advantageously it is provided that at least one guide element is a roller. A particularly smooth-running and continuous movement along the guide tracks is permitted thereby. As a result, an advantageous guided movement of the door itself is also achieved.

At least one guide element may be a plain bearing or a ball bearing or a rigid guide pin.

Advantageously it is provided that the rollers have different diameters, as different sizes. In particular, in this context it is provided that the lower roller has a larger diameter than the upper roller, when viewed in the height direction. Thus the lower roller in the height position, in particular, is that roller which is rotatably arranged on the guide bracket at a distance from the end sides of the guide bracket. Thus it is that roller, in particular, which predetermines the main guided movement. The smaller, upper roller which runs along the upper guide track when displaced is thus configured for assisting the movement and, in particular, for limiting the tilt of the guide bracket when it rotates about the lower roller.

In an advantageous embodiment, it is provided that the guide device has a first lower slotted guide and the lower guide track is, in particular, a lower limit of the first slotted guide. In an advantageous embodiment, the guide device has a second upper slotted guide which is separate from the first slotted guide, wherein the upper guide track is, in particular, an upper limit of the second slotted guide. In particular, the lower slotted guide is a lower limit of the lower slotted guide and the upper guide track is an upper limit of the upper slotted guide, when viewed in the height direction. The slotted guides are, in particular, groove-like and/or channel-like devices.

In particular, it is provided that the lower guide element is guided in the lower slotted guide and the upper guide element is guided in the upper slotted guide.

The slotted guides are, when viewed in the height direction, arranged at a distance from one another. The slotted guides are configured so as not to overlap, in particular when viewed over their entire length.

It is preferably provided that the lower guide track is directly formed on a bottom which defines the stowing space, and/or a front end in the depth direction of the lower guide track opens directly onto the bottom and/or a rear end of the lower guide track opens directly onto the bottom. As a result, the lower guide track is displaced to a maximum extent downwardly and effectively at least in some sections directly formed on the bottom. By means of such an embodiment, on the one hand, when the guide track is configured completely below the door in the inserted state of the door, a construction may nevertheless be achieved in the height direction such that the cooking chamber is not undesirably restricted when viewed over the entire height of the cooking appliance.

It is preferably provided that the two guide tracks are configured so as not to run parallel to one another, wherein this is viewed in the depth direction. Additionally or alternatively, it may be provided that the lower guide track is curved upwardly in a convex manner at least in some regions. As a result, when viewed in the depth direction, the movement of the guide bracket from the front starting point is initially guided upwardly, then it reaches a maximum and is then guided again downwardly to the rear end, when viewed in the depth direction to the rear. Additionally or alternatively, it may be provided that the upper guide track is configured in a rectilinear manner, in particular when viewed in the depth direction of the cooking appliance. In particular, by this cooperation of the non-parallel and in particular individually shaped guide tracks, an individual movement of the guide bracket may also be achieved, namely an individual rotation during the movement along the guide tracks. The insertion of the door into the stowing space and/or the removal of the door out of the stowing space may be facilitated by such a tilting movement about a horizontal axis oriented in the width direction. This is advantageous, in particular, in the case of doors which are configured to be correspondingly wide and thus also potentially have a greater weight in order to able to avoid, in particular, undesired tilting moments.

It is preferably provided that, when viewed in the width direction of the cooking appliance, at least a front pane of the door is wider than a distance between two opposing slotted guides in the width direction. In particular, therefore, when viewed in the width direction, the front pane is arranged so as to overlap with the guide tracks. Additionally or alternatively, it may be provided that a front pane of the door has a width of greater than 85 cm, in particular greater than 89 cm, for example 90 cm. The front pane, in particular, is a sub-element of a set of panes which comprises a plurality of separate panes. In this context, the front pane may have a greater width than the further panes of this set of panes.

A further independent aspect of the invention relates to a cooking appliance comprising a cooking chamber. The cooking appliance also comprises a door which is designed and arranged to close the cooking chamber. Moreover, the cooking appliance comprises a stowing space which is separate from the cooking chamber. The door can be lowered into this stowing space in the open state. The door is guided by a guide device of the cooking appliance as the door is moved into the stowing space and/or out of the stowing space. The guide device preferably has at least one slotted guide in which a guide unit of the guide device is guided. The guide unit is thus movable in the slotted guide relative to the slotted guide. The relevant guide unit is connected and thus mechanically coupled to the door. When viewed in the height direction of the cooking appliance, a guide track, in particular of the slotted guide, is arranged at least in a retracted end position of the door in the stowing space below the door. The guide unit has a guide bracket, at least two separate guide elements being arranged thereon. These guide elements are arranged at different height positions, when viewed in the height direction of the cooking appliance. The guide device has two separate slotted guides which are arranged at different height positions in the height direction. A lower guide element engages in the lower slotted guide and is guided on a lower guide track and the upper guide element engages in the upper slotted guide and is guided on the upper guide track. Embodiments of the aforementioned aspect are to be regarded as advantageous embodiments of the further independent aspect.

A further aspect of the invention relates to a method for operating a cooking appliance which is configured according to the aforementioned aspect or an advantageous embodiment thereof, wherein a damping unit of the cooking appliance, starting from an intermediate position of the door on the closing path of the door, is coupled to the guide unit such that at least a partial closing path is damped as the door is closed between the intermediate position and the completely closed end position of the door. Advantageous embodiments of the cooking appliance are to be regarded as advantageous embodiments of the method, wherein the relevant components are provided to this end for carrying out the respective sub-steps of the method and the sub-steps are carried out by the components.

The positions and orientations provided when the appliance is used as intended and arranged as intended are specified by the terms "top" "bottom", "front" "rear", "horizontal", "vertical", "depth direction", "width direction", "height direction".

Further features of the invention are disclosed in the claims, the figures and the description of the figures. The features and combinations of features mentioned above in the description and the features and combinations of features mentioned hereinafter in the description of the figures and/or shown individually in the figures are not only able to be used in the respectively specified combination but also in other combinations or individually without departing from the scope of the invention. Thus embodiments which are not explicitly shown and described in the figures, but which are revealed and able to be generated from the described embodiments, are also to be regarded as encompassed and disclosed by the invention. Thus embodiments and combinations of features which do not have all of the features of an originally formulated independent claim are also to be regarded as disclosed.

BRIEF DESCRIPTION OF THE DRAWINGS

Exemplary embodiments of the invention are described hereinafter with reference to schematic drawings, in which.

DETAILED DESCRIPTION OF EXEMPLARY EMBODIMENTS OF THE PRESENT INVENTION

Figure 1:
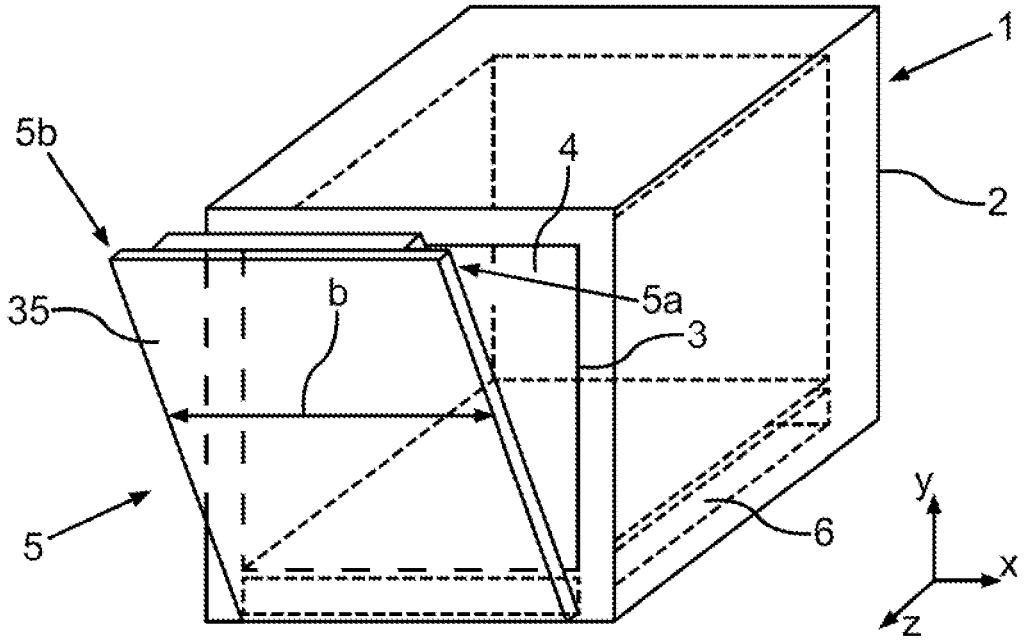
FIG. 1 shows a perspective view of an exemplary embodiment of a cooking appliance according to the invention.

Elements which are identical or functionally identical are provided in the figures with the same reference characters.

A cooking appliance 1 which, for example, may be an oven or a microwave cooking appliance or a steam cooking appliance or in this regard a combination appliance, is shown in FIG. 1 in a schematic view.

The cooking appliance 1 has a housing 2 in which a muffle 3 is arranged. The muffle 3 defines with its walls a cooking chamber 4. The cooking appliance 1 also has a door 5 which is movably arranged on the housing 2. In particular, a muffle of the cooking appliance 1 which defines the cooking chamber 4 with its walls may also be assigned to the housing 2. Thus the door 5 may also be arranged on the muffle. The door 5 is arranged for closing the cooking chamber 4 on the front side.

Moreover, the cooking appliance 1 has a stowing space 6 which is separate from the cooking chamber 3 and thus from the cooking chamber 3. This stowing space 6 is configured below the cooking chamber 3 in the height direction (y-direction). The stowing space 6 is configured for receiving the door 5 in the open state of the door 5. The door 5 in the open state is lowerable into the stowing space 6.

Figure 2:
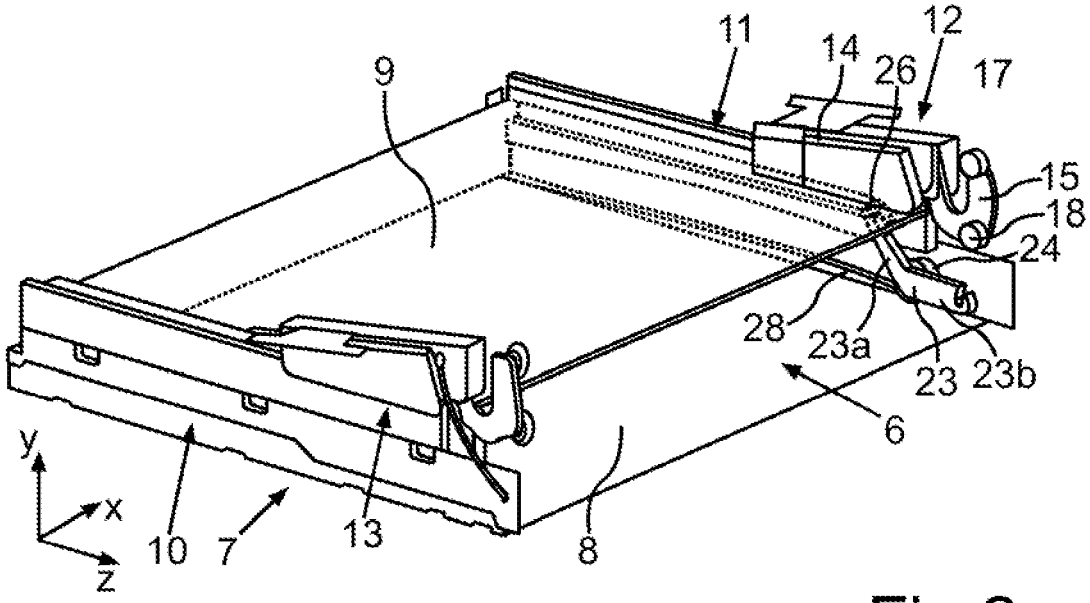
FIG. 2 shows a perspective view of a bottom subassembly of the cooking appliance according to FIG. 1.

An exemplary embodiment of a bottom subassembly 7 of the cooking appliance 1 is shown in FIG. 2 in a perspective view. In this case, the stowing space 6 which is defined by a bottom 8, a ceiling wall 9 and side walls 10 and 11 is shown. The door 5 is not shown in FIG. 2 for the sake of clarity.

Opposing hinges 12 and 13 which are arranged on the side walls 10 and 11, positioned at the top, are shown in FIG. 2. The hinges 12 and 13 are configured to be structurally the same, such that the further description is made only relative to the hinge 12. This hinge has a hinge housing 14 and a hinge bracket 15 rotatably arranged thereon. In this case, the hinge bracket 15 is configured, in particular, to be U-shaped. The hinge bracket 15 is coupled to the door 5. To this end, the door 5 has on opposing vertical side edges 5*a*, 5*b* slotted guides which are open to the side, one slotted guide 16 thereof being shown in FIG. 3. Rollers 17 and 18 which are rotatably arranged on the hinge brackets 15 engage in this slotted guide 16.

Figure 3:
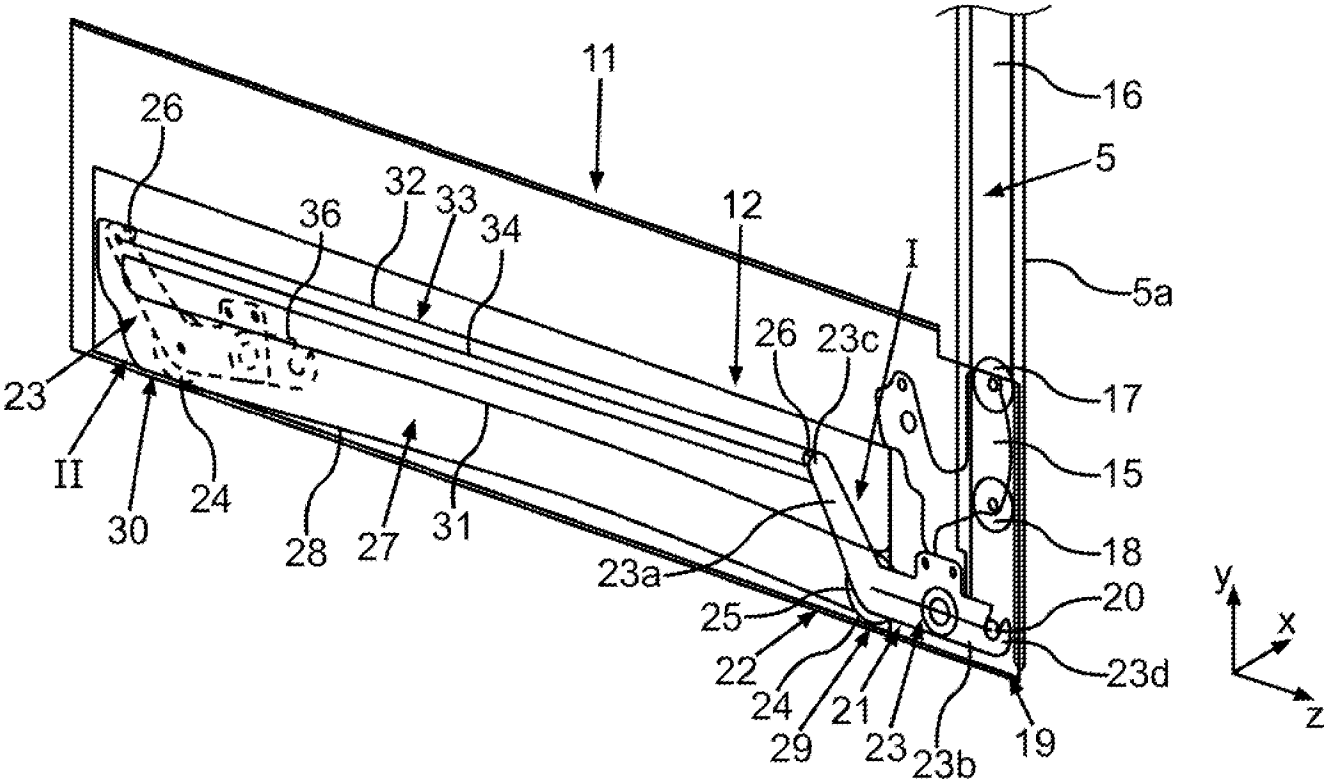
FIG. 3 shows a simplified view of sub-components of a guide device for guiding a door of the cooking appliance into a stowing space or out of a stowing space, with a view of a guide bracket in two different end positions.

A side view of the side wall 11 is shown in FIG. 3 in a simplified view, with a view out of the stowing space 6. As may be identified here, the door 5 is connected at its lower end 19 to a coupling rod 20 which extends in the width direction (x-direction). A guide unit 21 which is a component of a guide device 22 of the cooking appliance 1 is connected to this coupling rod 20. The door 5 is guided into the stowing space 6 or guided out of this stowing space 6 by means of the guide device 22. The guide unit 21 has a one-piece guide bracket 23 which is configured here, in particular, in a V-shaped and/or boomerang-like manner. To this end, a first V-arm 23*a* is provided, together with a second V-arm 23*b* adjoining thereto at a corresponding angle. The guide bracket 23, in particular with a free end 23*d*, is movably connected directly to the coupling rod 20, in particular rotatably connected thereto. In this case a relative movement between the door 5 and the guide bracket 23 is permitted about the rotational axis defined by the coupling rod 20.

In the embodiment of the guide bracket 23, the guide unit 21 has a lower separate guide element 24, when viewed in the height direction, which in this case is a roller. The lower guide element 24 is rotatably arranged on the guide bracket 23. In particular, this lower guide element 24 is arranged at a distance from the free ends 23*c* and 23*d* of the V-arms 23*a*, 23*b* of the guide bracket 23. In particular, this lower guide element 24 is rotatably arranged in a V-tip 25 of the V-shape of the guide bracket 23.

Moreover, a second separate guide element 26 is arranged on the guide bracket 23. This second guide element 26 is preferably also a roller and is movably, in particular rotatably, arranged relative to the guide bracket 23. In the exemplary embodiment, this second upper guide element 26, when viewed in the height direction, is rotatably arranged on the end 23*c* of the guide bracket 23. It is thus positioned at the end side on the guide bracket 23.

As may be identified in FIG. 3 the two separate guide elements 24 and 26 are arranged at different height positions, when viewed in the height direction. The guide bracket 23 is thus positioned such that it predetermines the different height positions of the guide elements 24 and 26. In FIG. 3 the guide bracket 23 is shown in two different end positions—in the depth direction which corresponds to the z-direction. On the one hand, the front end position in which the door 5 is completely closed is shown. This is shown by the position I. On the other hand, the second rear end position of the guide bracket 23 is shown by the position II.

As may be identified, the two guide elements 24 and 26 have different sizes, in particular different diameters. The lower guide element 24 has in this context a greater diameter than the upper guide element 26.

As may also be identified, this different height position of the guide elements 24 and 26 is preferably not only provided in the end positions shown but, in particular, over the entire movement path of the guide bracket 23 between the end positions shown.

The guide device 22 also has a first lower slotted guide 27. This lower slotted guide 27 is configured in the vicinity of the bottom and has a guide track 28 which represents a lower guide track. In this context, this lower guide track 28 is directly configured at least in some regions on the bottom 8. In the exemplary embodiment shown, the lower guide track 28 directly opens at a front end 29 onto the bottom 8. Additionally or alternatively, it may be provided that the lower guide track 28 opens in a rear end 30 directly onto the bottom 8, when viewed in the depth direction.

In particular, the guide track 28 is not of rectilinear configuration. The guide track is preferably curved upwardly in a convex manner. As may be identified in FIG. 3, the lower guide element 24 is coupled to this lower guide track 28. This means, in particular, that this lower guide element 24 runs directly along this lower guide track 28, positioned thereon. The lower guide track 28 is a lower limit of the lower slotted guide 27, when viewed in the height direction. The slotted guide 27 is also defined by an upper limit 31. The lower slotted guide 27 is thus of groove-like configuration. As may be identified, the diameter of the lower guide element 24 is advantageously dimensioned such that it is substantially arranged relatively without clearance in the slotted guide 27. This means that a clearance in the height direction is minimized but the rolling behavior of the guide element 24 in the slotted guide 27 is not affected.

It is also preferably provided that the guide device 22 has an upper guide track 32. This upper guide track 32, in particular, is a component of an upper slotted guide 33. The upper slotted guide 33, when viewed in the height direction, is arranged at a distance from and without contact with the lower slotted guide 27. The upper slotted guide 33 is advantageously defined upwardly by the upper guide track 32. In particular, the upper slotted guide 33 is defined downwardly by a lower limit 34. The upper slotted guide 33 thus, in particular, also represents a groove-like and/or channel-like embodiment in the side wall 11. As may be identified, the paths of the two guide tracks 28 and 32 in the depth direction are different. They are thus not parallel to one another. It may preferably be provided that the upper guide track 32 is rectilinear, in particular is oriented completely horizontally.

As may be identified, the upper guide element 26 is coupled to the upper guide track 32 and thus, in particular, is designed to bear directly against this guide track 32 from below and/or in the embodiment of the guide element as a roller is designed to roll directly thereon. It is also provided in this case that the diameter of the upper guide element 26 is dimensioned such that an insertion into the upper slotted guide 33 is possible with a relatively accurate fit. This also means that effectively a minimum clearance is formed such that this upper guide element 26 is able to roll in the slotted guide 33 without difficulty but the clearance in the height direction is minimized.

Advantageously it is provided that the door 5 has a width b measured in the width direction (x-direction) (FIG. 1) which, when viewed in this width direction, is greater than a distance provided in this regard between the guide tracks 28 and 32 on the side wall 11 and the corresponding guide tracks on the opposing side wall 10. Thus when viewed in the width direction an overlap of the door 5 with these guide tracks 28 is formed on the opposing side walls 11 and 10 and/or between the upper guide tracks 32 on the opposing side walls 10 and 11. In particular, this is provided for a front pane 35 (FIG. 1) of the door 5. Thus it is possible to install doors 5 which have a relatively large width, wherein the width b may be greater than 85 cm, in particular greater than 89 cm, in particular 90 cm.

In particular, it is also provided that with such embodiments of doors 5, but not only in these embodiments, the door 5 in the state inserted into the stowing space 6 is arranged completely above at least the lower guide track 28, when viewed in the height direction. This may also be identified by the position of the guide bracket 23 in its inserted end position in FIG. 3. A coupling point 36 of the guide bracket 23 at which the guide bracket 23 is coupled to the coupling rod 20, in this case is located higher than the guide track 28.

Figure 4:
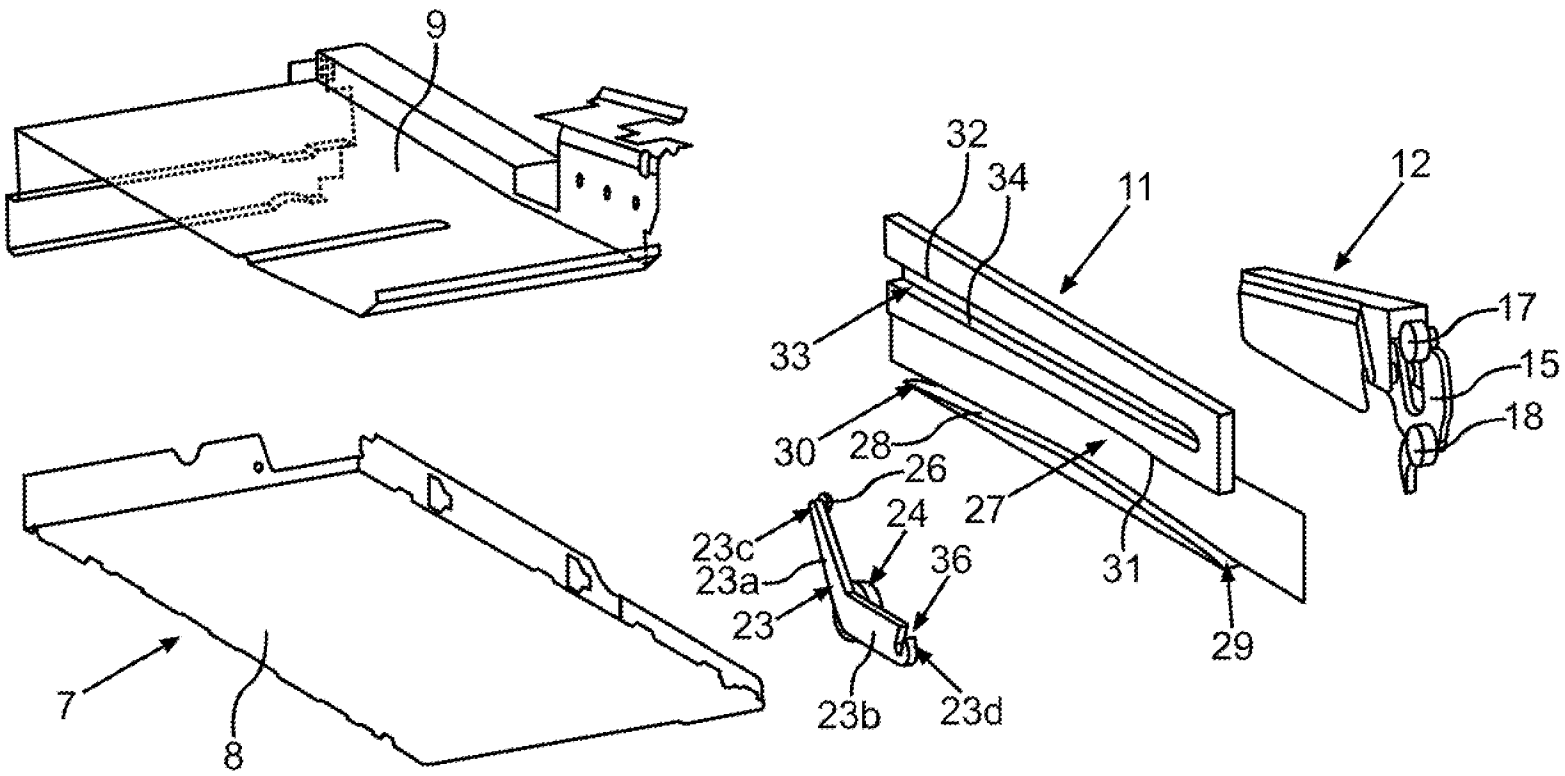
FIG. 4 shows an exploded view of sub-components of the bottom subassembly according to FIG. 2.

In FIG. 4 the bottom subassembly 7 is shown in sub-components in an exploded view. The side wall 11 may be made, for example, from metal or a plastics material. The side wall may be configured in one piece or multiple pieces. For example, the side wall may be designed in two pieces or even in three pieces. An embodiment made of a fiber-containing semi-finished product may also be provided, such as for example BMC (Bulk Molding Compound).

Figure 5:
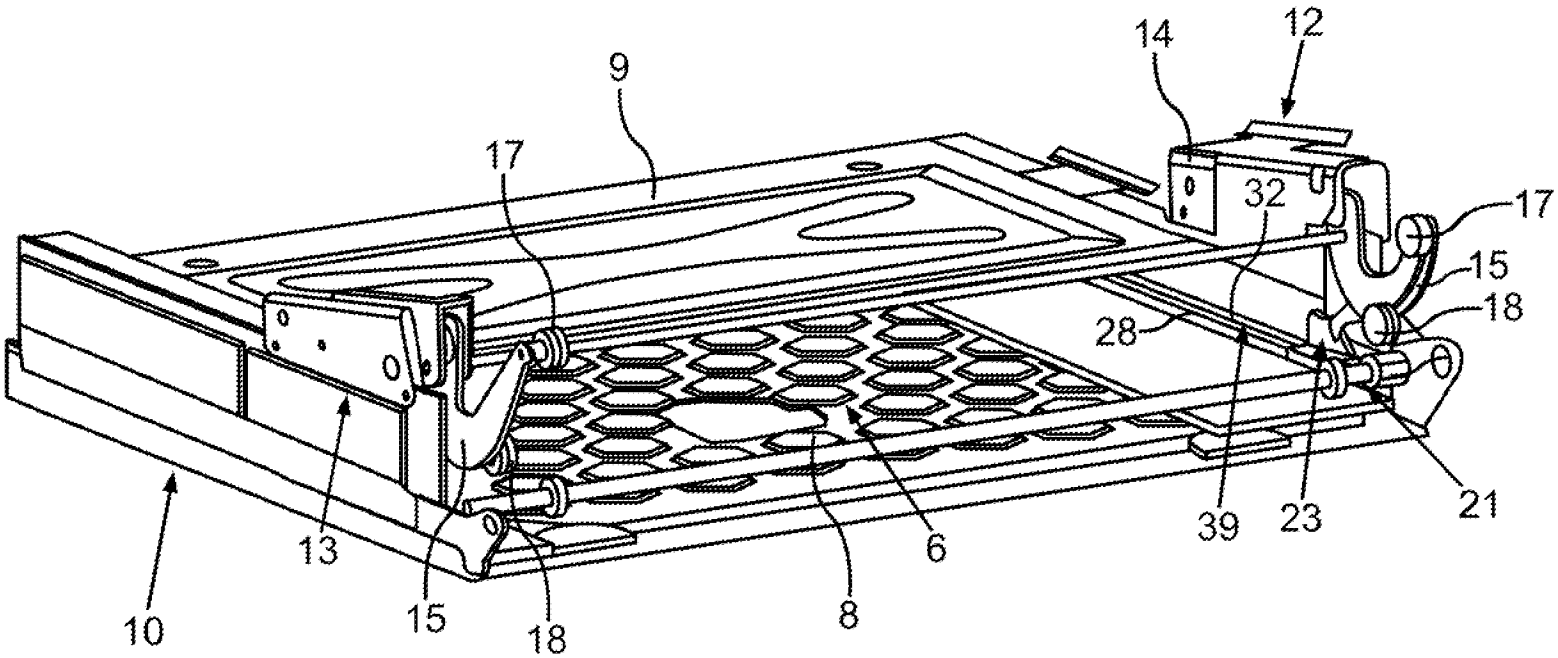
FIG. 5 shows a perspective view of a further exemplary embodiment of a bottom subassembly of the cooking appliance according to FIG. 1.

A bottom subassembly 7 according to a further exemplary embodiment of a cooking appliance 1 is shown in FIG. 5 in a perspective view. In contrast to the embodiment in FIGS. 2 to 4, here the guide device 22 is configured differently. In this case, the guide unit 21 also has a guide bracket 23. In this case, however, it is positioned in a rectilinear and oblique manner. Two upper guide elements 26 are arranged on this guide bracket 23 in the exemplary embodiment here (FIG. 7). Also in this case, the guide elements 26 may be rollers or plain bearings or ball bearings. The two upper guide elements 26 are arranged, in particular, at the same height position to one another. Moreover, the guide device 21 has lower guide elements 24 (FIG. 7), in this case two. These lower guide elements are also configured here as rigid elements, in particular guide pins. In this case, the lower guide elements 24 are configured in one piece with the guide bracket 23. In contrast to the exemplary embodiment according to FIGS. 2 to 4, in the exemplary embodiment according to FIGS. 5 to 7 the upper guide elements 26 are arranged so as to be positioned from above on the upper guide track 32 and the upper guide elements 26 are arranged at a distance from the lower guide track 28. Moreover, it is provided here that the lower guide elements 24 bear from below against the lower guide track 28 and are arranged at a distance and without contact with the upper guide track 32.

A web 37 (FIG. 7), the upper face thereof forming the upper guide track 32 and the lower face thereof forming the lower guide track 28, is thus encompassed from below by the lower guide elements 24. An undesired tilting moment of the guide bracket 23 is also avoided thereby.

Figure 6:
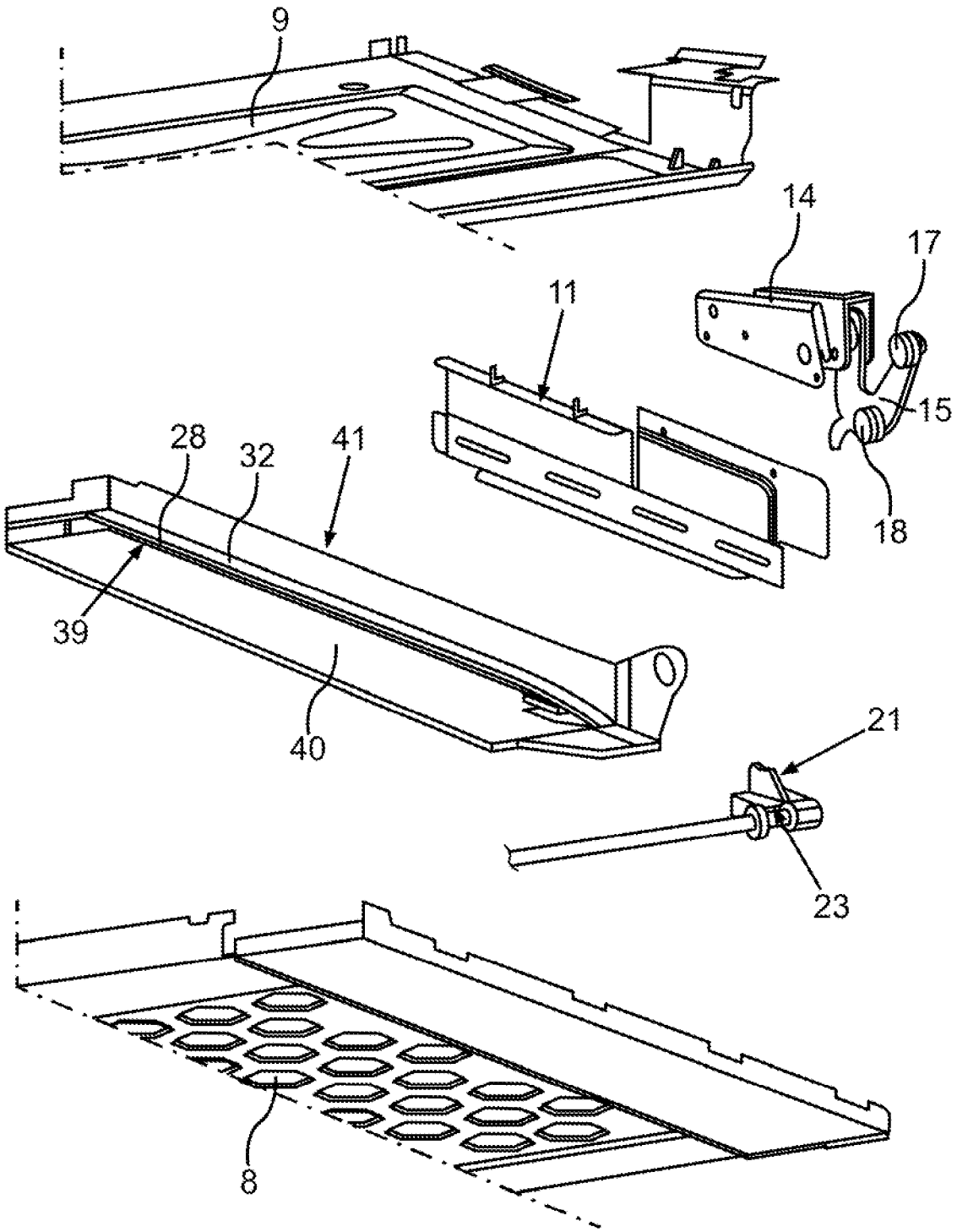
FIG. 6 shows an exploded view of sub-components of the bottom subassembly according to FIG. 5.
Figure 7:
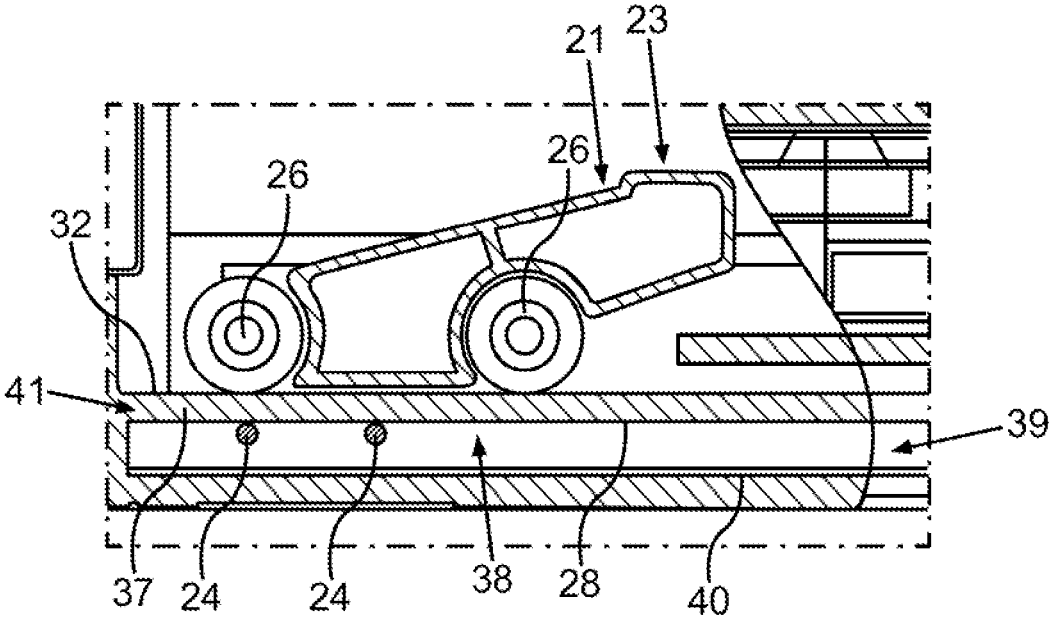
FIG. 7 shows a sectional view through sub-components of the bottom subassembly according to FIGS. 5 and 6.

As may be identified in FIG. 6, which shows an exploded view of sub-components of the arrangement in FIG. 5, a cavity 38 which forms a slotted guide 39 is formed between the lower guide track 28 and the bottom part 40. The lower guide elements 24 are arranged and guided in this slotted guide 39.

As may also be identified in FIG. 6 the slotted guide 39 and the bottom part 40 are configured in one piece in a component 41 separate from the bottom 8. The component 41 is thus positioned on the bottom 8 in the mounted state.

A sectional view of the guide bracket 23, the upper guide elements 26, the lower guide elements 24, the guide tracks 28, 32 and further regions are shown in FIG. 7.

The components of the guide device 22, described with reference to FIGS. 5 to 7, are arranged on a side region of the bottom subassembly 7. The same is configured on the opposing side region of the bottom subassembly 7 in the width direction. This also applies to the example according to FIGS. 2 to 4.

Figure 8:
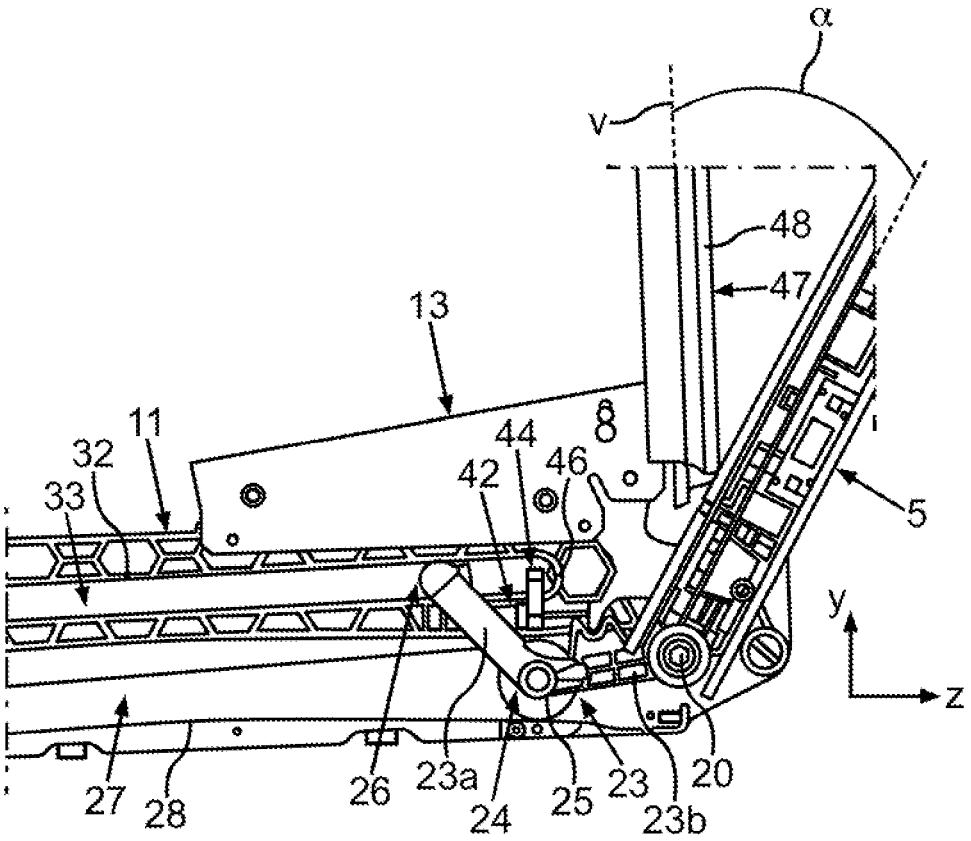
FIG. 8 shows a more detailed view of a sub-region of FIG. 3 in which a damping unit is shown and the door of the cooking appliance is shown in a position on its closing path in which the damping of the damping unit is not yet active.

In FIG. 8 a side view is shown in a partial view in which the door 5, in particular and by way of example, is moved from the completely open end position in the direction of the completely closed end position. In particular, an angle $\alpha$ has a specific value between the plane, in which the door 5 with its plate-like and/or flat embodiment extends, and a vertical V. In the embodiment shown in FIG. 8 it is shown that the door 5 is transferred from the open position into the completely closed position. In the view shown in FIG. 8, in this context, an intermediate position is reached in which the movement of the door 5 is not yet damped.

The cooking appliance 1 has at least one damping unit 42. This damping unit 42 is a separate component which, when viewed in the height direction (y-direction), is arranged between the upper slotted guide 33 and the lower slotted guide 27. In this case it may be provided that this damping unit 42, when viewed in the height direction, is arranged without overlapping this upper slotted guide 33 and/or the lower slotted guide 27. In particular, this damping unit 42, when viewed in the height direction, is arranged in a free space between the upper guide track 32 and the lower guide track 28, in particular arranged without overlapping the upper guide track 32 and/or the lower guide track 28. The damping unit 42 is arranged, in particular, on the side wall 11. At least in some regions, when viewed in the width direction, the damping unit may be recessed therein and/or arranged embedded therein. The side wall 11 forms, in particular, the carrier part for the damping unit 42.

The damping unit 42 may preferably be a pneumatic or hydraulic damper.

Advantageously, the damping unit 42 is positioned such that it is arranged in the depth direction (z-direction) facing the door 5 in a front longitudinal third of the entire length of the upper slotted guide 33, in particular the upper guide track 32.

The damping unit 42 is configured and arranged such that, from an intermediate position on its closing path, the door 5 is coupled to the guide unit 21, in particular the guide bracket 23, and from this coupled state on the further closing path to the completely closed end position of the door 5, in this regard at least one partial closing path 43 (FIG. 9) is damped as the door 5 is closed between the intermediate position and the completely closed end position. In an advantageous embodiment, on this partial closing path 43 the damping unit 42 is directly coupled to the guide unit 21, in particular the guide bracket 23. It may also be provided that the cooking appliance 1 has a transmission element 44 (FIG. 8) which is directly connected to the damping unit 42. In this context, an integrated embodiment and thus an embodiment configured in one piece therewith may also be provided. In this embodiment, therefore, the transmission element 44 is a component of the damping unit 42 and forms a part thereof. However, it may also be provided that the transmission element 44 is a separate component. This component may be arranged, for example, in a non-destructive and releasable manner on the damping unit 42.

In particular, the transmission unit 44 is configured in one piece. In the embodiment shown in FIG. 8 the transmission element 44, when viewed in the height direction, extends upwardly and is preferably arranged so as to overlap with the upper slotted guide 33. In particular, however, in this embodiment no overlap is present in this height direction with the upper guide track 32.

Figure 9:
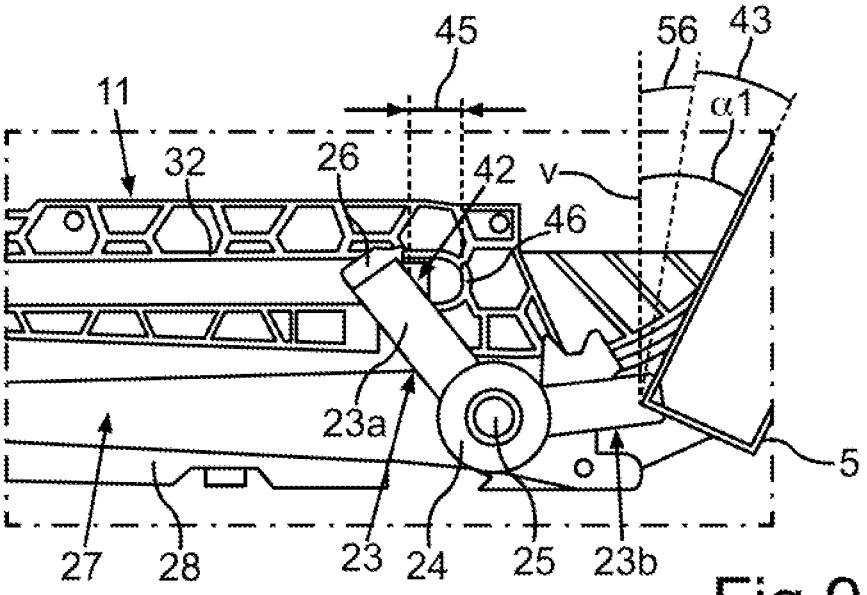
FIG. 9 shows the view according to FIG. 8 in which the door is shown in a position in which it is already further closed in comparison with FIG. 8 and the damping of the damping unit is active.

If the door 5 is now closed further, starting from the exemplary view in FIG. 8, an angular position with the angle $\alpha l$ is reached as is shown in FIG. 9. From this angular position of the door 5, the coupled state is present between the guide unit 21, in particular the guide bracket 23, and the damping unit 42. In particular, this may be carried out by a direct coupling between the guide bracket 23 and the transmission element 44. This is shown in FIG. 9. In this state in which the direct mechanical coupling between the guide bracket 23 and the damping unit 42, in particular the transmission element 44 occurs, the damping unit 42, in particular the transmission element 44, is at a distance 45 measured in the depth direction from a front end 46 of the upper slotted guide 33, in particular the upper guide track 32. This distance 45 is preferably between 20 mm and 25 mm, in particular 23 mm.

The partial closing path also begins with this contact which occurs between the guide bracket 23 and the damping unit 42, in particular the transmission element 44. In this regard, the assigned angular position with the angle $\alpha l$ of the door 5 to the vertical V in this case is preferably between 20° and 12°, in particular between 17° and 13°, for example 15°.

If the door 5 is now closed, starting from the intermediate position shown in FIG. 9 in which the partial closing path 43 to the closed position begins, and moved toward a flange 47 (FIG. 8) of the housing 2 on which a seal 48 is preferably arranged, the guide unit 21, in particular the guide bracket 23, is moved further forward, when viewed in the depth direction, whereby the guide bracket 23 actuates the damper and/or the damping unit 42 in contact therewith. In this regard, the actuation takes place in the exemplary embodiment by the driver element and/or the transmission element 44 which is displaced therewith by the movement of the guide bracket 23 toward the front end 46. At the same time, the damping action of the damping unit 42 occurs, such that the door 5 is damped on its partial closing path to the closed position.

In an advantageous embodiment it is provided that this damping action takes place on a partial closing path 43 which does not reach as far as the completely closed end position of the door 5. In particular, it may be provided that the movement of the door 5 is not damped on an end closing path 56, which during the closing process adjoins the partial closing path and which extends from the partial closing path end to the completely closed position of the door 5. For example, in this context, it may be provided that the damping unit 42 has a freewheel such that this end closing path 56 is not damped. Preferably, the end closing path 56 is a path length which corresponds to an angular interval of between 8° and 12°, starting from the vertical V. In such an embodiment, the partial closing path extends over an angular interval of preferably between 12° and 4°.

Preferably a further damping unit 42, which is not shown in the figures, is additionally arranged on the opposing side wall 10.

Figure 10:
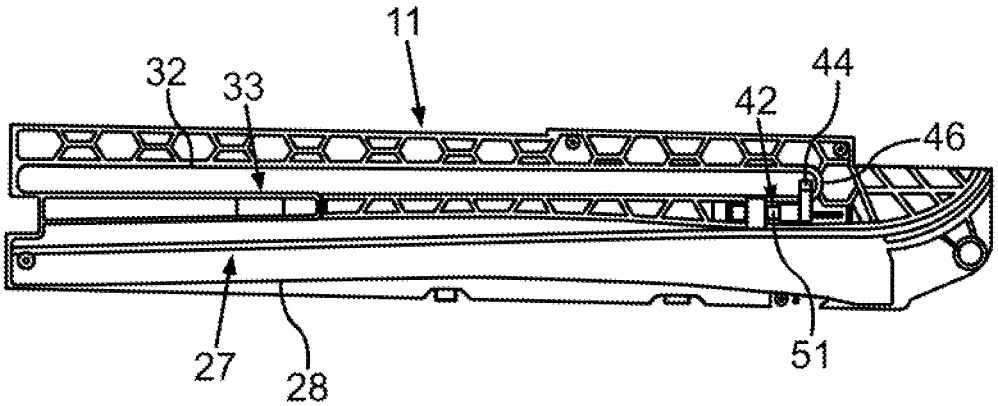
FIG. 10 shows a view of a side wall which defines the stowing space for the door, wherein the damping unit is arranged on the side wall.

In FIG. 10 the side wall 11 is shown in a side view. In this case only the module with the side wall 11 and the damping unit 42 is shown. In particular, the transmission element 44 is also arranged and shown here. The further components are not shown in FIG. 10.

Figure 11:
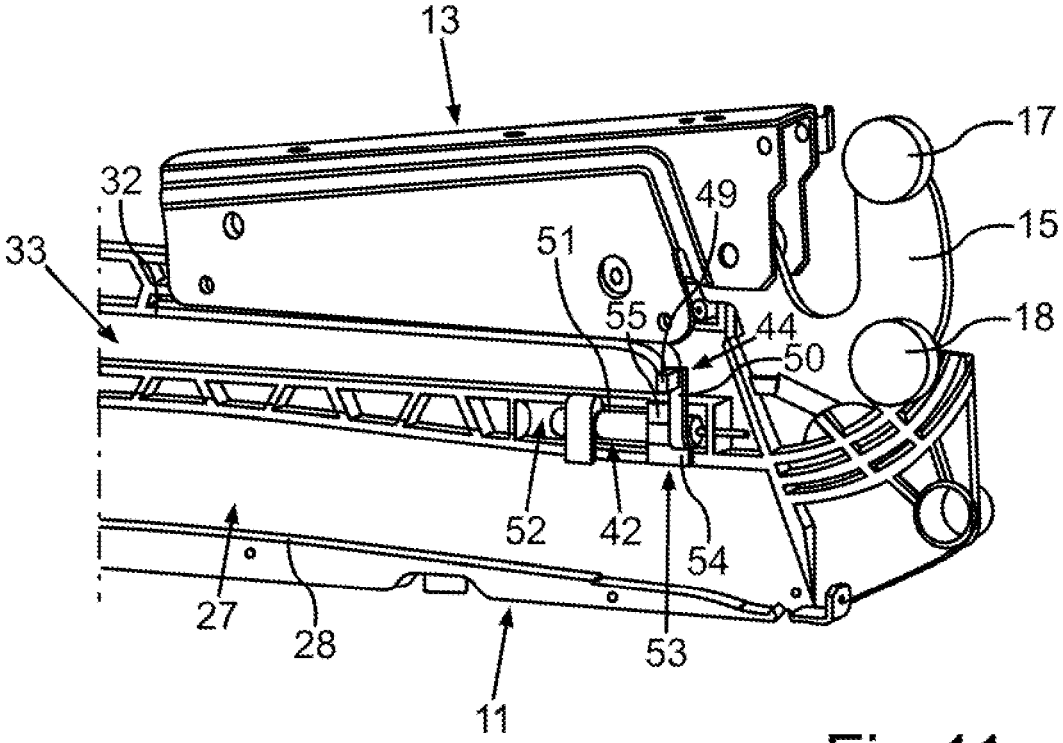
FIG. 11 shows a perspective view of FIG. 10 with additional components of the cooking appliance.

In FIG. 11 in a perspective view the arrangement of the damping unit 42 and the transmission element 44 is shown. Further components, as also illustrated in FIG. 8, are also shown. In the view in FIG. 11 it may also be identified that in an advantageous embodiment the transmission element 44 is a bracket. In particular, the bracket has an upside-down L-shape. In this regard, the bracket is oriented in the width direction with a bottom arm 49 of the L-shape and protrudes into the movement path of the guide bracket 23 when this moves in the depth direction. A base arm 50 of this L-shape is oriented in the height direction and extends upwardly.

In this embodiment it is provided that the transmission element 44 is a separate component. The transmission element 44 may be arranged in a non-destructive and releasable manner on the damping unit 42. As may be identified in FIG. 10 and FIG. 11, the damping unit 42 has a cartridge-like housing 51. This means that it is formed in a tubular and/or cylindrical manner. This housing 51 extends in the depth direction, in particular parallel or substantially parallel to the slotted guides 27 and/or 33.

In particular, this housing 51 is arranged without overlapping these slotted guides 27 and/or 33, when viewed in the height direction. As may be identified in FIG. 10 and FIG. 11 the side wall 11 has a receiver 52 which is a recess and/or a depression. The damping unit 42, in particular the housing 51, is arranged at least in some regions so as to be recessed and/or embedded in this recess 52.

Moreover, it may be identified in FIG. 11 that the transmission element 44 has an anti-rotation device 53. This anti-rotation device is formed in the exemplary embodiment shown by two upwardly and downwardly protruding webs 54 and 55 which bear against the side wall 11. A rotation of the transmission element 44 about an axis which is oriented in the depth direction may be avoided thereby.

In contrast, in FIG. 10 an embodiment is shown in which the transmission element 44 is configured in one piece with the damping unit 42, in particular the housing 51. In particular in this embodiment, therefore, such an anti-rotation device 53 is not required and not configured.

Figure 12:
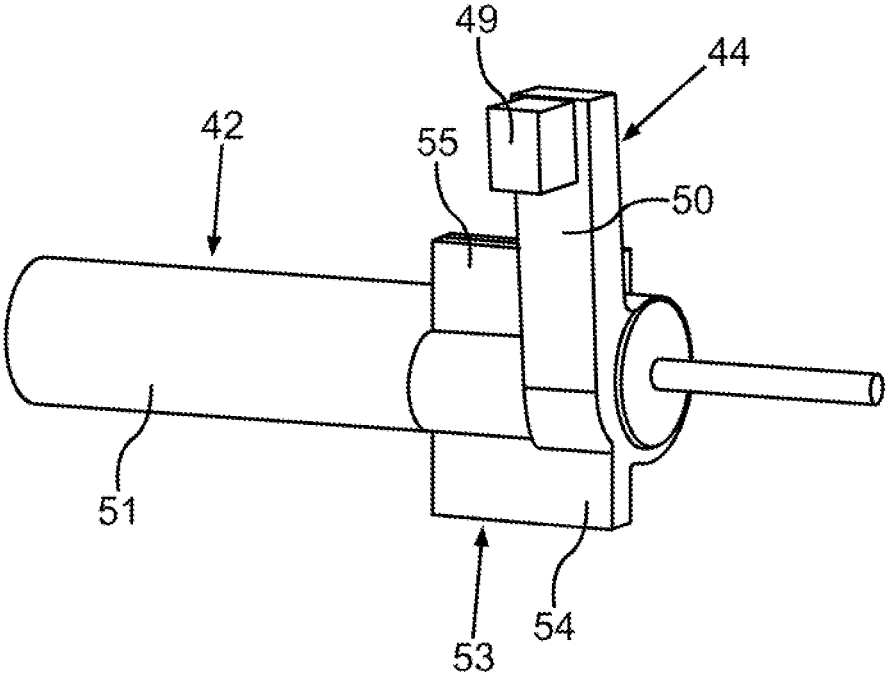
FIG. 12 shows an exemplary embodiment of a damping unit with a transmission element.

In FIG. 12 the embodiment of the damping unit 42 with the transmission element 44 according to FIG. 11 is shown in an enlarged view.

Figure 13:
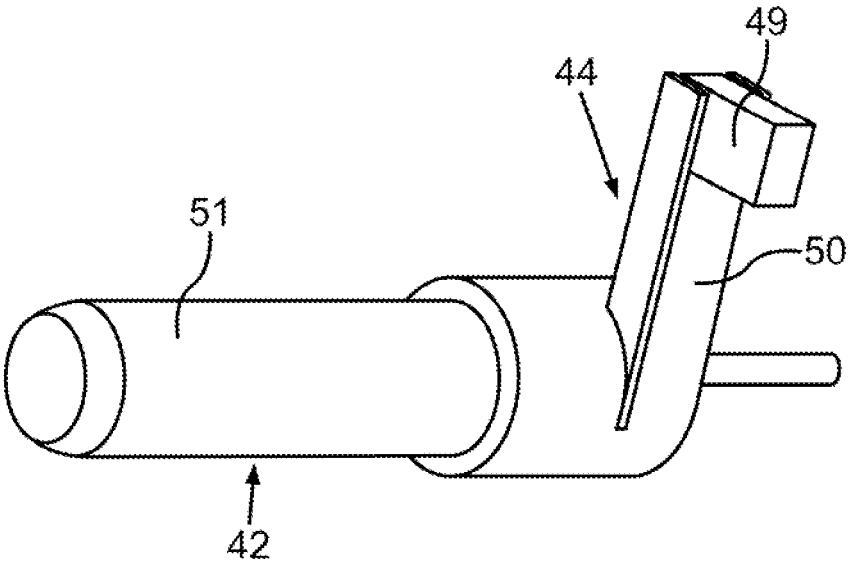
FIG. 13 shows a further exemplary embodiment of a damping unit with a transmission element.

In FIG. 13 the embodiment of the damping unit 42 according to FIG. 10 is shown in a perspective view.

The invention claimed is:

1. A cooking appliance, comprising:

a cooking chamber;

a door for closing the cooking chamber;

a stowing space which is separate from the cooking chamber and into which the door can be lowered, when opening the door;

a guide device configured to guide the door as the door moves into the stowing space or out of the stowing space, said guide device including a slotted guide and a guide unit which is connected to the door and guided in the slotted guide, said guide unit including a guide bracket and two separate guide elements arranged on the guide bracket at different height positions, when viewed in a height direction, so as to define a lower guide element and a higher guide element, with the lower guide element moving on a lower guide track and arranged without contact with an upper guide track, which is separate from the lower guide track, and with the higher guide element moving on the upper guide track and arranged without contact with the lower guide track; and a damping unit which, starting from an intermediate position of the door on a closing path of the door, is coupled to the guide unit such that at least a partial closing path is damped as the door is closed between the intermediate position and a completely closed end position of the door, wherein one of:

the damping unit, when viewed in the height direction, is arranged between the upper guide track and the lower guide track, the damping unit is arranged below the upper guide track the partial closing path extends shy of the completely closed end position so as to define an end closing path which adjoins the partial closing path as the door is closed and extends as far as the completely closed end position of the door and which is undamped, and the damping unit has a freewheel to deactivate a damping action on the end closing path.

2. The cooking appliance of claim 1, wherein the stowing space is defined by a vertical side wall, with the upper guide track being configured in the side wall and the damping unit being arranged on the side wall.

3. The cooking appliance of claim 1, wherein the upper guide track, when viewed in a depth direction of the cooking appliance, has a front longitudinal third, said damping unit being arranged below the upper guide track completely in the longitudinal third of the upper track.

4. The cooking appliance of claim 1, wherein the damping unit is configured as a pneumatic or hydraulic damper and/or is configured with a cartridge-like housing.

5. The cooking appliance of claim 1, wherein the damping unit is coupled directly to the guide unit on the partial closing path.

6. The cooking appliance of claim 1, further comprising a transmission element directly coupled to the guide unit on the partial closing path, said damping unit being directly connected to the transmission element.

7. The cooking appliance of claim 6, wherein the transmission element is configured as a bracket.

8. A cooking appliance, comprising:

a cooking chamber;

a door for closing the cooking chamber;

a stowing space which is separate from the cooking chamber and into which the door can be lowered, when opening the door;

a guide device configured to guide the door as the door moves into the stowing space or out of the stowing space, said guide device including a slotted guide and a guide unit which is connected to the door and guided in the slotted guide, said guide unit including a guide bracket and two separate guide elements arranged on the guide bracket at different height positions, when viewed in a height direction, so as to define a lower guide element and a higher guide element, with the lower guide element moving on a lower guide track and arranged without contact with an upper guide track, which is separate from the lower guide track, and with the higher guide element moving on the upper guide track and arranged without contact with the lower guide track;

a damping unit which, starting from an intermediate position of the door on a closing path of the door, is coupled to the guide unit such that at least a partial closing path is damped as the door is closed between the intermediate position and a completely closed end position of the door; and a transmission element directly coupled to the guide unit on the partial closing path, said damping unit being directly connected to the transmission element, wherein the transmission element is configured as a bracket, and wherein the bracket is L-shaped.

9. The cooking appliance of claim 6, wherein the transmission element is arranged for displacement in a depth direction of the cooking appliance such that the transmission element is guided forward with the guide unit to activate the damping unit for executing a damping action, when the guide unit is coupled to the transmission element and the guide unit is moved further on the partial closing path in the depth direction.

10. The cooking appliance of claim 9, wherein the transmission element includes a guide web configured to form an anti-rotation device for the transmission element as the transmission element moves in the depth direction about an axis oriented in the depth direction.

11. The cooking appliance of claim 1, wherein the slotted guide is an upper slotted guide which includes the upper guide track, said damping unit, when coupled to the guide unit for damping the movement of the door on the partial closing path, has a distance from a front end of the upper slotted guide of between 20 mm and 30 mm, when measured in a depth direction of the cooking appliance.

12. The cooking appliance of claim 11, wherein the distance is between 20 mm and 25 mm.

13. The cooking appliance of claim 1, wherein the door defines an initial portion of the partial closing path, when the door extends at an angular position of between 20° and 12° relative to a vertical during closing of the door.

14. The cooking appliance of claim 13, wherein the angular position of the door is between 17° and 13° relative to the vertical.

15. A cooking appliance, comprising:

a cooking chamber;

a door for closing the cooking chamber;

a stowing space which is separate from the cooking chamber and into which the door can be lowered, when opening the door;

a guide device configured to guide the door as the door moves into the stowing space or out of the stowing space, said guide device including a slotted guide and a guide unit which is connected to the door and guided in the slotted guide, said guide unit including a guide bracket and two separate guide elements arranged on the guide bracket at different height positions, when viewed in a height direction, so as to define a lower guide element and a higher guide element, with the lower guide element moving on a lower guide track and arranged without contact with an upper guide track, which is separate from the lower guide track, and with the higher guide element moving on the upper guide track and arranged without contact with the lower guide track; and a damping unit which, starting from an intermediate position of the door on a closing path of the door, is coupled to the guide unit such that at least a partial closing path is damped as the door is closed between the intermediate position and a completely closed end position of the door;

wherein the partial closing path extends shy of the completely closed end position so as to define an end closing path which adjoins the partial closing path as the door is closed and extends as far as the completely closed end position of the door and which is undamped, and wherein the end closing path is dimensioned over an angular interval of between 8° and 12° relative to a vertical.

* * * * *